United States Patent [19]

York et al.

[11] 4,454,915

[45] Jun. 19, 1984

[54] IN SITU RETORTING OF OIL SHALE WITH AIR, STEAM, AND RECYCLE GAS

[75] Inventors: Earl D. York, Englewood; Jay C. Knepper, Denver, both of Colo.

[73] Assignees: Standard Oil Company (Indiana); Gulf Oil Corporation, both of Chicago, Ill.

[21] Appl. No.: 391,473

[22] Filed: Jun. 23, 1982

[51] Int. Cl.[3] ..... E21B 43/263; E21B 43/40

[52] U.S. Cl. ..... 166/259; 166/260; 166/261; 166/266

[58] Field of Search ..... 166/247, 259, 260, 261, 166/266, 267; 299/2

[56] References Cited

U.S. PATENT DOCUMENTS

| | | | |
|---|---|---|---|
| 1,269,747 | 6/1918 | Rogers | 299/2 |
| 3,342,257 | 9/1967 | Jacobs et al. | 166/247 |
| 3,596,993 | 8/1971 | Busey | 166/261 X |
| 4,014,575 | 3/1977 | French et al. | 166/267 X |
| 4,017,119 | 4/1977 | Lewis | 299/2 |
| 4,117,886 | 10/1978 | Honaker | 299/2 X |
| 4,167,291 | 9/1979 | Ridley | 299/2 |
| 4,192,381 | 3/1980 | Cha | 166/261 |
| 4,246,965 | 1/1981 | Cha | 166/261 X |
| 4,315,656 | 2/1982 | Hall | 166/261 X |
| 4,353,418 | 10/1982 | Hoekstra | 166/259 |

*Primary Examiner*—George A. Suchfield

*Attorney, Agent, or Firm*—Thomas W. Tolpin; William T. McClain; William H. Magidson

[57] ABSTRACT

A flame front is ignited and passed through an underground oil shale retort to produce shale oil. The flame front is supported by a specially blended feed gas consisting essentially of air, steam and retort off gases. Product yield and quality are increased by varying the volumetric ratio of air, steam and retort off gases in the feed gas during retorting in proportion to the oil yield, or the relative richness, leanness and kerogen content of the oil shale being heated by the flame front, or in proportion to the amount of carbon residue on the retorted shale being combusted.

9 Claims, 1 Drawing Figure

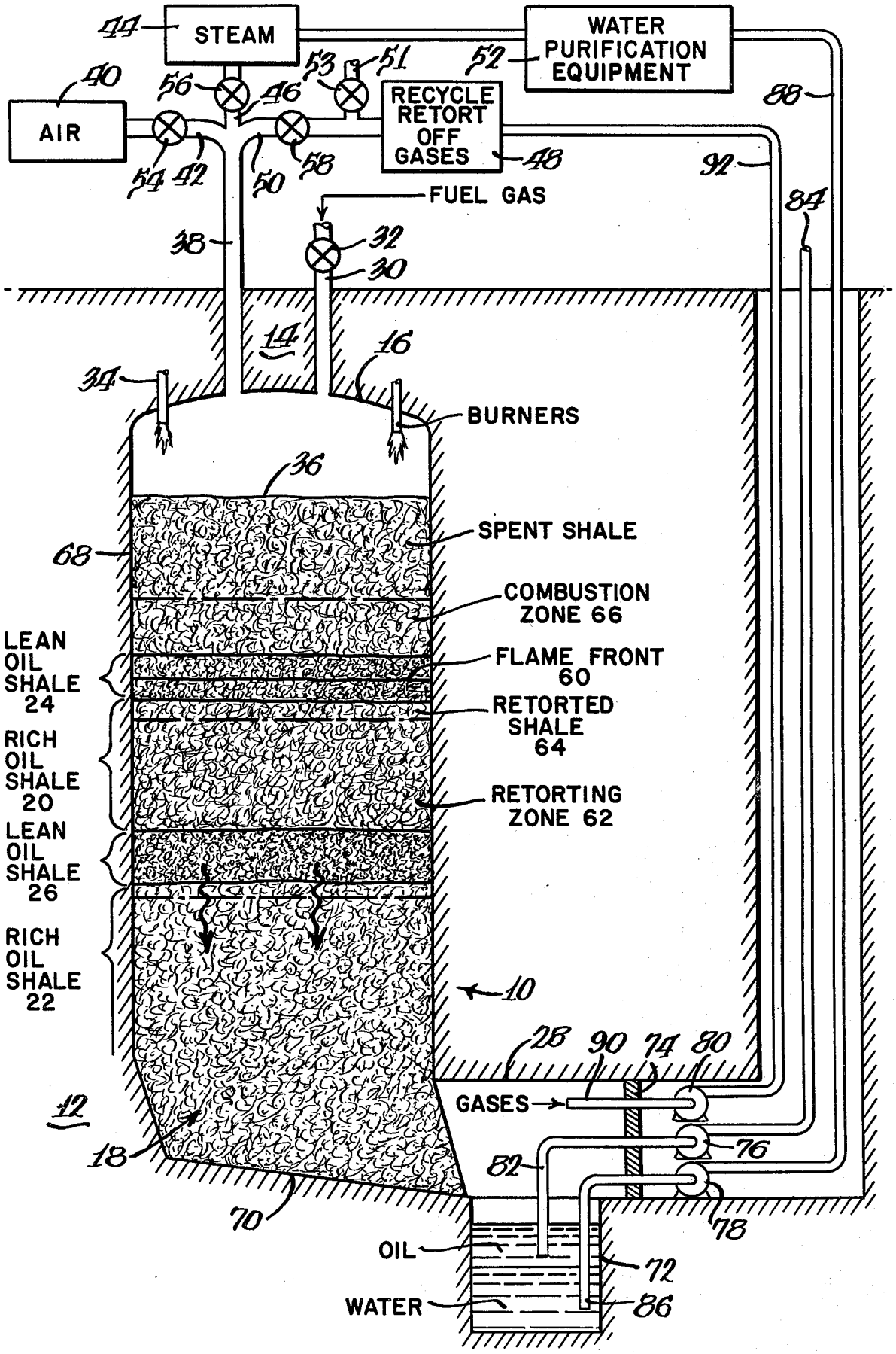
STEAM
WATER PURIFICATION EQUIPMENT
AIR
RECYCLE RETORT OFF GASES
FUEL GAS
BURNERS
SPENT SHALE
COMBUSTION ZONE 66
FLAME FRONT 60
RETORTED SHALE 64
RETORTING ZONE 62
LEAN OIL SHALE 24
RICH OIL SHALE 20
LEAN OIL SHALE 26
RICH OIL SHALE 22
GASES
OIL
WATER
44
40
56
46
53
51
52
88
54
42
50
58
48
92
84
38
32
30
14
16
34
36
68
10
28
90
74
80
12
18
76
82
70
78
72
86

IN SITU RETORTING OF OIL SHALE WITH AIR, STEAM, AND RECYCLE GAS

BACKGROUND OF THE INVENTION

This invention relates to a process for underground retorting of oil shale.

Researchers have now renewed their efforts to find alternative sources of energy and hydrocarbons in view of recent rapid increases in the price of crude oil and natural gas. Much research has been focused on recovering hydrocarbons from solid hydrocarbon-containing material such as oil shale, coal and tar sands by pyrolysis or upon gasification to convert the solid hydrocarbon-containing material into more readily usuable gaseous and liquid hydrocarbons.

Vast natural desposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil is contained in oil shale deposits in the United States with almost sixty percent located in the rich Green River oil shale deposits of Colorado, Utah, and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

Underground formations of oil shale contain various layers, deposits or strata of rich and lean oil shale. The relative richness, leanness, and depth of these layers typically vary throughout the underground formation and depend upon the particular location of the formation.

The process of pyrolyzing the kerogen in oil shale, known as retorting, to form liberated hydrocarbons, can be done in surface retorts in aboveground vessels or in in situ retorts under ground. In situ retorts require less mining and handling than surface retorts.

In vertical in situ retorts, a flame front is passed downward through a bed of rubblized oil shale to liberate shale oil, off gases and residual water. Rich oil shale yields more shale oil and leaves more carbon residue on the retorted shale than lean oil shale. When a sufficient quantity of carbon residue remains on the shale, it provides fuel for the flame front. When insufficient carbon residue exists, as is the case with lean shale, some of the oil produced is not liberated, but is burned to supply the needed fuel.

There are two types of in situ retorts: true in situ retorts and modified in situ retorts. In true in situ retorts, none of the shale is mined, holes are drilled into the formation, and the oil shale is explosively rubblized, if necessary, and then retorted. In modified in situ retorts, some of the oil shale is removed by mining to create a cavity or void space in the retorting area. The cavity provides extra space which is filled with rubble after blasting to provide void space in the bed. The oil shale which has been removed is conveyed to the surface and is available for aboveground retorting.

Over the years various methods for in situ retorting of oil shale have been suggested. Typifying the many methods of in situ retorting are those found in U.S. Pat. Nos. 1,913,935; 1,191,636; 2,481,051; 3,001,776; 3,586,377; 3,434,757; 3,661,423; 3,917,344; 3,951,456; 4,007,963; 4,017,119; 4,036,299; 4,089,375; 4,105,072; 4,117,886; 4,120,355; 4,126,180; 4,133,380; 4,149,752; 4,153,299; 4,158,467; 4,162,808; 4,166,022; 4,185,871; 4,191,251; 4,222,850; 4,194,788; 4,241,952; 4,243,100; 4,263,969; 4,271,904 and 4,285,547; and in an article of the *Tenth Oil Shale Symposium Proceedings,* at pages 166–178, entitled "Computer Model, for In-Situ Oil Shale Retorting: Effects of Gas Introduced Into the Retort" by R. L. Braun and R. C. Y. Chin of Lawrence Livermore Laboratory, University of California, published by the Colorado School of Mines Press (July 1977). These prior art methods have met with varying degrees of success.

It is therefore desirable to provide an improved process for in situ retorting of oil shale.

SUMMARY OF THE INVENTION

An improved process and feed gas composition are provided for in situ retorting of oil shale, which is effective, efficient and relatively easy to use. In the process, a flame front is ignited and passed through an in situ oil shale retort to liberate shale oil. Desirably, the flame front is supported and driven through the retort with a special flame front-supporting feed gas consisting of air, steam and retort off gases. Air in the feed gas provides oxygen to sustain the flame front. Steam in the feed gas moderates the temperature of the flame front in order to prevent excessive temperatures, minimize thermal cracking and increase the heat capacity of the gas. Off gases in the feed gas supply the fuel required to support the flame front through layers of lean oil shale, which typically contain inadequate amounts of residual carbon to support the flame front. Off gases in the feed gas are preferably obtained from effluent retort off gases produced in the same retort, although they can be obtained from another underground retort or from a surface retort.

Desirably, the proportion of air, steam and off gases in the feed gas is varied in response to the oil yield or the leanness, richness and/or kerogen content of the raw oil shale being heated by the flame front, or in proportion to the amount of carbon residue on the retorted shale being combusted by the flame front. The quantity of off gas increases as the shale richness decreases and vice versa. No off gas is needed with a sufficiently rich shale that deposits an adequate supply of coke.

The process is preferably carried out in a generally upright, modified in situ retort, although it can be carried out in a horizontal, irregular shaped and/or a true in situ retort.

The volume ratios used throughout this application are relative to the condition of the subject gases at a temperature of 77° F. (25° C.) at atmospheric pressure.

As used throughout this application, the terms "retorted oil shale" and "retorted shale" refer to oil shale which has been retorted to liberate hydrocarbons leaving an organic material containing carbon residue.

The terms "spent oil shale" and "spent shale" as used herein, mean retorted shale from which most of the carbon residue has been removed by combustion.

A more detailed explanation of the invention is provided in the following description and appended claims taken in conjunction with the accompanying drawing.

BRIEF DESCRIPTION OF THE DRAWING

The FIGURE is a schematic cross-sectional view of an in situ retort for carrying out a process and using a special feed gas in accordance with principles of the present invention.

DETAILED DESCRIPTION OF THE PREFERRED EMBODIMENT

Referring now to the drawing, an underground, modified in situ, oil shale retort 10 located in a subterranean formation 12 of oil shale is covered with an overburden 14. Retort 10 is elongated, upright and generally box-shaped, with a flat top or dome-shaped roof 16. Retort 10 is filled with an irregularly packed, fluid permeable, rubblized mass or bed 18 of raw oil shale fragments containing different amounts of kerogen. The average particle size of the fragmented oil shale is up to 5 inches, although large oil shale boulders of 10 inches or more and minute oil shale particles or fines may be present.

Bed 18 contains rubblized layers of rich oil shale 20 and 22 and lean oil shale 24 and 26 of different depths. Lean oil shale is more brittle and fragile than rich oil shale and yields from about 7.7 to 15 gallons of shale oil per ton of raw oil shale. Rich oil shale yields more than 15 gallons of shale oil to as much as 32 gallons or more of shale oil per ton of raw oil shale. Very rich oil shale yields as much as 65 to 85 gallons of shale oil per ton of raw oil shale.

Bed 18 is formed by first mining an access tunnel or drift 28 extending horizontally into the bottom of retort 10 and removing from 2% to 40% and preferably from 25% to 35% by volume of the raw oil shale from the retort to form a cavity or void space. The removed oil shale is conveyed to the surface and is available for retorting in an aboveground retort. The mass of oil shale above the cavity is then fragmented and expanded by detonation of explosives to form the rubblized mass which substantially fills the cavity. The cavity, after blasting, provides the desired porosity in the rubble bed.

A fuel gas line 30 extends from above ground level through overburden 14 into the top 16 of retort 10. The extent and rate of fuel gas flowing through line 32 are regulated and controlled by fuel gas valve 32. Downhole burners 34 extend downwardly through the roof 16 of the retort to a location slightly above the top 36 of the bed 18 of oil shale.

A feed gas line 38 extends from above ground level through overburden 14 into the roof 16 of retort 10. More than one feed gas line can be used. Feed line 38 is connected to: an air supply 40, such as a compressor or air blower, through air line 42; a steam source 44, such as a steam generator, superheater or boiler, through steam line 46; and recycle gas source 48, through recycle gas line 50. Retort gas in excess of the quantity desired as recycle gas is withdrawn from the system through bleed line 51 upon opening bleed line valve 53. The air, steam and recycle off gas are fed together into retort 10 through common feed gas line 38, although they can be fed separately into the retort through separate lines, if desired. The extent and rate of air, steam and recycle off gas flow through feed gas line 38 are regulated and controlled by air valve 54, steam valve 56 and recycle gas valve 58, respectively.

The steam for the feed gas can be obtained by vaporizing water in a steam generator 44. The water can be obtained from the retort 10, a pond, tank or an underground aquifer. The water is preferably filtered and/or purified in water purification equipment 52. If water is vaporized to produce steam, it is preferred that the water be entirely vaporized above ground in order to enhance feed gas flow and control, as well as to minimize hydraulic and liquid/gas flow problems.

Off gases in the feed gas are preferably obtained by recycling the effluent off gases from retort 10, but can also be obtained from another underground retort or a surface retort. The effluent off gases can be stripped of light hydrocarbon gases in a scrubber or stripper before being recycled to recycle gas tank 48 for use as part of the feed gas.

In order to commence retorting of the rubblized mass 18 of oil shale, a liquid or gaseous fuel, preferably a combustible ignition gas or fuel gas, such as recycle off gases or natural gas, is fed into retort 10 through feed line 30 and a flame front-supporting feed gas is fed into retort 10 through feed gas line 38. Burners 34 are ignited to establish a flame front 60 horizontally across the bed 18. If economically feasible or otherwise desirable, the rubblized mass 18 of oil shale can be preheated to a temperature slightly below its retorting temperature with an inert preheating gas, such as flue gas, steam, nitrogen or retort off gases, before introduction of feed gas and ignition of the flame front. After ignition, fuel valve 32 is closed to shut off the inflow of fuel gas. Once the flame front is established, recycle retort off gases contained in the feed gas and residual carbon (carbon residue) on the retorted oil shale provide an adequate source of fuel to maintain the flame front.

Flame front 60 emits combustion off gases and generates heat which moves sequentially downwardly ahead of flame front 60 and heats the raw, unretorted oil shale in retorting zone 62 to a retorting temperature from 800° F. to 1,200° F. to retort and pyrolyze the raw oil shale in the retorting zone. During retorting, hydrocarbons are liberated from the raw oil shale as a gas, vapor, mist or liquid droplets and most likely a mixture thereof. The liberated hydrocarbons include light hydrocarbon gases and normally liquid shale oil which flow downward, condense and liquify upon the cooler, unretorted raw shale below the retorting zone.

During retorting, retorting zone 62 moves downward leaving a layer or band of retorted shale 64 containing residual carbon. The layer of retorted shale 64 above retorting zone 62 defines a retorted zone which is located between retorting zone 62 and the flame front 60 of combustion zone 66. Residual carbon on the retorted shale is combusted in combustion zone 66 leaving spend combusted shale in a spend shale zone 68.

Spent shale provides fuel for the flame front 60. More carbon residue is formed during retorting of rich oil shale than of lean oil shale. Generally, the richer the shale the greater the amount of carbon residue formed. Lean oil shale, typically, does not yield a sufficient quantity of residual carbon to supply sufficient heat for retorting without additional fuel which is supplied by unrecovered shale oil, if the feed gas contains steam and/or air only, or by retort off gases, if the feed gas includes retort off gases as well as steam and air. If the feed gas contains more retort off gas than needed to supplement the available heat from carbon combustion, the efficiency is reduced because recycle retort off gas is burned in preference to the residual carbon.

The feed gas sustains, supports and drives the flame front 60 downwardly through the bed 18 of oil shale. The feed gas is fed into the retort through feed gas line 38 and is a blend of air, steam and recycle retort off gases. The blend of air, steam and recycle retort off gases in the feed gas is selectively varied and controlled during retorting to carefully balance: (1) the amount of steam needed to moderate and cool the flame front 62 to avoid sintering the spent shale and to minimize thermal cracking, (2) the amount of recycle retort off gases needed to serve as a fuel to supplement the residual carbon residue on the retorted shale in order to minimize shale oil burning, and (3) the amount of air needed to sustain combustion and maintain the desired advance rate of the flame front.

During retorting, the proportion of the air, steam and recycle retort off gases in the feed gas is varied in response to the relative leanness, richness and kerogen content of the raw oil shale being heated by the flame front or the amount of carbon residue on the retorted shale being combusted in the combustion zone 90. In the preferred process, the volume ratio of air, steam and retort off gases in the feed gas is varied in relationship to grade or quantity of the oil shale being retorted. When commencing feed gas injection, when the relative leanness, richness or kerogen content of the oil shale is not yet known, the volumetric ratio of air, steam and recycle retort off gases can be 2:1:1, or 50 mole percent air, 25 mole percent steam and 25 mole percent recycle retort off gases.

For best retorting efficiency and product quality, the volumetric ratio of air, steam and recycle retort off gases in the feed gas should be 5:0.1:10 for an oil yield of 7.7 gallons per ton of raw oil shale; 5:2:6 for an oil yeild of 15 gallons per ton of raw oil shale; 5:2:2 for an oil yield of 25 gallons per ton of raw oil shale; and 5:2:0.1 for an oil yield of 32 or more gallons per ton of raw oil shale.

Retort off gases emitted during retorting include various amounts of hydrogen, carbon monoxide, carbon dioxide, ammonia, hydrogen sulfide, carbonyl sulfide, oxides of sulfur and nitrogen, steam and low molecular weight hydrocarbons such as methane, ethane, ethene, propane and propene. The precise composition of the retort off gases is dependent upon the feed gas composition and flow rate, and the kerogen content of the oil shale.

The effluent product steam of liquid shale oil, oil shale retort water and retort off gases emitted during retorting, flows downward to the sloped bottom 70 of retort 10 and then into a collection basin and separator 72, also referred to as a "sump," in the bottom of access tunnel 28. Concrete wall 74 prevents leakage of off gas into the mine. The liquid shale oil, retort water and off gases are separated in collection basin 72 by gravity and pumped to the surface by pumps 76 and 78 and blower 80, respectively, through inlet and return lines 82, 84, 86, 88, 90 and 92, respectively. Blower 80 could equally well be located on the surface.

Effluent shale oil from line 84 is upgraded to syncrude by dust removal and hydrotreating or other processing in equipment not shown in the drawing. Retort water in line 88 is filtered and/or otherwise purified in purification equipment 52 and subsequently vaporized in steam generator 46 for use as part of the feed gas or discharged into a collection pond. Excess retort off gas is removed from the system through bleed line 51 and used as appropriate elsewhere.

Among the many advantages of the above process and feed gas composition are:

1. Improved product yield and recovery.
2. Less loss of product oil.
3. Greater retorting efficiency.
4. Minimized sintering.

Although an embodiment of this invention has been shown and described, it is to be understood that various modifications and substitutions, as well as rearrangements and combinations of process steps, can be made by those skilled in the art without departing from the novel spirit and scope of this invention.

What is claimed is:

1. A process for retorting oil shale, comprising the steps of:

explosively forming an underground retort with fragmented layers of lean and rich, raw oil shale;

establishing a flame front in said underground retort;

sequentially heating said oil shale to a retorting temperature ranging from 800° F. to 1200° F. by passing said flame front sequentially through said retort to liberate shale oil and off gases from said oil shale;

supporting said flame front with a feed gas consisting essentially of air, steam and said off gases;

withdrawing said shale oil and off gases from said retort;

recycling said withdrawn off gases for use in said feed gas; and varying the proportion of said air, steam and off gases in said feed gas for different leannesses and richnesses of said oil shale being heated by said flame front by increasing the proportion of said off gases in said feed gas for leaner grades of oil shale and decreasing the proportion of said off gases in said feed gas for richer grades of oil shale.

2. A process in accordance with claim 1 wherein light hydrocarbon gases and shale oil vapors are recovered from said off gases above ground before said off gases are recycled for use in said feed gas.

3. A process in accordance with claim 1 wherein a generally vertical underground retort is formed.

4. A process in accordance with claim 1 wherein a generally horizontal underground retort is formed.

5. A process in accordance with claim 1 wherein said proportion is about 5:0.1:10 by volume for an oil yield of 7.7 gallons per ton of raw oil shale.

6. A process in accordance with claim 1 wherein said proportion is about 5:2:6 by volume for an oil yield of 15 gallons per ton of raw oil shale.

7. A process in accordance with claim 1 wherein said proportion is about 5:2:2 by volume for an oil yield of 25 gallons per ton of raw oil shale.

8. A process in accordance with claim 1 wherein said proportion is about 5:2:0.1 by volume for an oil yield of 32 gallons per ton of raw shale.

9. A process in accordance with claim 1 wherein retort oil shale water is produced during retorting and said water is vaporized above ground for use as said steam in said feed gas.

* * * * *

UNITED STATES PATENT OFFICE
CERTIFICATE OF CORRECTION

Patent No. 4,454,915 Dated June 19, 1984

Inventor(s) Earl D. York, Jay C. Knepper

It is certified that error appears in the above-identified patent and that said Letters Patent are hereby corrected as shown below:

| Patent Column | Line | |
|---|---|---|
| 4 | 13 | reads "flow" and should read --flowing-- |
| 4 | 36 | reads "feed" and should read --fuel-- |
| 5 | 1 | reads "spend" and should read --spent-- |
| 5 | 2 | reads "spend" and should read --spent-- |

Signed and Sealed this

*Sixth* Day of *August 1985*

[SEAL]

*Attest:*

DONALD J. QUIGG

*Attesting Officer* *Acting Commissioner of Patents and Trademarks*